US005899336A

United States Patent [19]

Kataoka

[11] Patent Number: 5,899,336

[45] Date of Patent: May 4, 1999

[54] SHEET OF CORRUGATED PAPER FOR PRODUCING A PACKAGE

[75] Inventor: Hachiro Kataoka, Nagoya, Japan

[73] Assignee: Chuo Pack Industry Co., LTD., Aichi-ken, Japan

[21] Appl. No.: 08/944,440

[22] Filed: Oct. 6, 1997

[30] Foreign Application Priority Data

Oct. 4, 1996 [JP] Japan ..... 8-264677

[51] Int. Cl.[6] ..... B65D 81/02

[52] U.S. Cl. ..... 206/592; 206/320; 206/576; 229/127

[58] Field of Search ..... 206/305, 320, 206/521, 576, 585, 586, 590, 592, 593, 587; 229/127, 185.1

[56] References Cited

U.S. PATENT DOCUMENTS

| | | | |
|---|---|---|---|
| 3,239,127 | 3/1966 | Spencer | 206/521 |
| 3,438,482 | 4/1969 | Hamilton | 206/320 |
| 3,923,235 | 12/1975 | Roccaforte . | |
| 4,034,908 | 7/1977 | Forbes, Jr. et al. . | |
| 4,211,356 | 7/1980 | Tsuchiya et al. | 206/592 |
| 4,388,999 | 6/1983 | Berry et al. | 206/521 |
| 5,145,070 | 9/1992 | Pallett et al. . | |
| 5,788,077 | 8/1998 | Sisk | 206/521 |

FOREIGN PATENT DOCUMENTS

| | | |
|---|---|---|
| 0549 874 A1 | 7/1993 | European Pat. Off. . |
| 0642977 A1 | 3/1995 | European Pat. Off. . |

*Primary Examiner*—Paul T. Sewell
*Assistant Examiner*—Luan K. Bui
*Attorney, Agent, or Firm*—Lowe Hauptman Gopstein Gilman & Berner

[57] ABSTRACT

A flat sheet 100 of corrugated paper is disclosed that can be folded into a package 200 for packing a fax machine or similar product. The sheet 100 comprises (i) first, second, third, and fourth side wall members 1A, 1B, 1C and 1D that are divided from other members of the sheet by parallel folding lines A and B extending from one edge of the sheet to an opposed edge thereof and that are divided from one another by parallel transversely-extending folding lines N, 0, and P, (ii) a tab member 1E provided subsequent to the fourth side wall member 1D and divided therefrom by a transversely-extending folding line M, (iii) a first side member 2A, first bottom member 2B, second side member 2C, and second bottom member 2D which are located on one side of the first, second, third and fourth side wall members 1A, 1B, 1C, and 1D, respectively, and which are divided from these side wall members 1A to 1D by the folding line A, and (iv) a first outer lid member 3A, first inner lid member 3B, second outer lid member 3C, and second inner lid member 3D that are located on an opposed side of the first, second, third and fourth side wall members 1A, 1B, 1C, and 1D, respectively, and which are divided from these side wall members 1A to 1D by the folding line B.

4 Claims, 8 Drawing Sheets

SHEET OF CORRUGATED PAPER FOR PRODUCING A PACKAGE

FIELD OF THE INVENTION

This invention relates to a sheet of corrugated paper for producing a package.

BACKGROUND OF THE INVENTION

Styrene foam is widely used to pack, among others, electric or electronic products, in corrugated cartons. This use of styrene foam, however, is a waste of valuable material when we consider the material is derived from limited natural resources, or petroleum. Also, disposing of packings of styrene foam causes not a few troublesome problems. So we should avoid using styrene foam as such packings and instead should use other suitable material for the same purpose. Actually, then, packings of corrugated paper is also used for this purpose, and the use of this material as such packings should be much more encouraged since this material does not cause similar serious problems to styrene foam. The most widely used packings of corrugated paper are block-shaped packings produced by bonding sheets of corrugated paper together. These packings, however, have to be prepared in addition to a corrugated carton in which to pack a product. Also, it takes much time and trouble to prepare these packings. Also, these block-shaped packings take up a lot of space and are therefore awkward to move or carry.

SUMMARY OF THE INVENTION

Accordingly, it is the object of the invention to provide a single flat sheet of corrugated paper that can be readily folded into a package in which one can pack a fax machine or similar product without using any packings of styrene foam or corrugated paper.

DETAILED DESCRIPTION OF THE INVENTION

Figure 1:
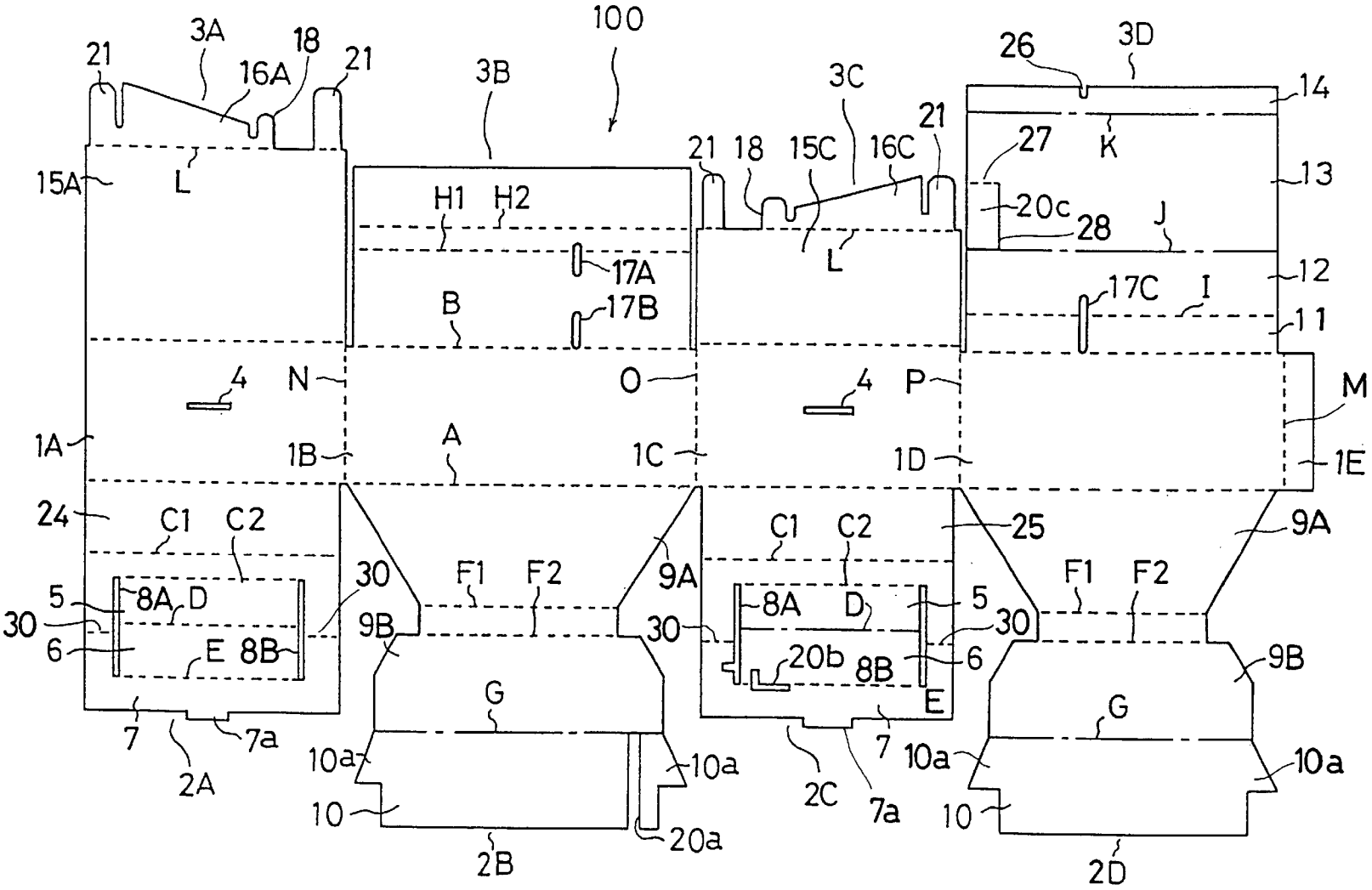
FIG. 1 shows a flat sheet 100 of corrugated paper prepared according to the invention.

A sheet 100 of corrugated paper of FIG. 1 prepared according to the invention will now be described in detail.

Figure 11:
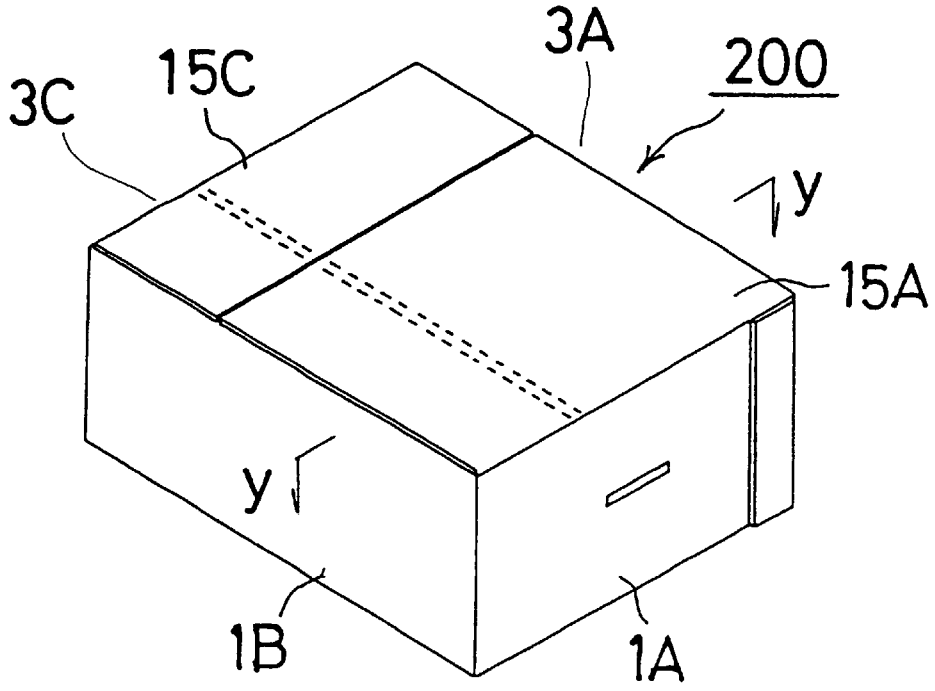
FIG. 11 shows a completed package 200 produced by closing another outer lid member 3A too.

As hereinafter described in detail, this sheet 100 can be folded into a square package 200 of FIG. 11. As illustrated in FIG. 1, the sheet 100 includes four side wall members 1A, 1B, 1C, and 1D that are divided from other members of the sheet by parallel folding lines A and B extending from one edge of the sheet to an opposed edge thereof. As shown, the four side wall members are divided from one another by transversely-extending folding lines N, 0, and P. On the right side of the side wall member 1D is provided a tab member 1E that is divided from the side wall member 1D by a transversely-extending folding line M. The side wall member 1A is provided with a longitudinally-extending slit 4. So is the side wall member 1C.

On one side of the side wall members 1A, 1B, 1C and 1D are provided a side member 2A, bottom member 2B, side member 2C, and bottom member 2D, respectively. On the opposed side of the side wall members 1A to 1D are located an outer lid member 3A, inner lid member 3B, outer lid member 3C, and inner lid member 3D, respectively. Those members 2A, 2B, 2C and 2D are divided from the side wall members by the folding line A, whereas those members 3A, 3B, 3C, and 3D are divided therefrom by the folding line B.

Each side member (2A and 2C) includes a bottom section 24, lower shelf section 5, inner wall section 6, and upper shelf section 7. The side member also has parallel slits 8A and 8B. The bottom section 24 is located between the folding line A and a folding line C1. The lower shelf section 5 is defined by a folding line C2, the slits 8A and 8B, and a folding line D. The inner wall section 6 is defined by the folding line D, the slits 8A and 8B, and a folding line E. The upper shelf section 7 is an outermost section of the side member, and is generally divided from the inner wall section 6 by the folding line E. Each side member also has a projecting portion 7*a* to be inserted into the slit 4 of the side wall member when the sheet 100 is folded into the package 200 of FIG. 11. Also, each side member includes short longitudinally-extending folding lines 30, 30 that are aligned with each other but are slightly offset against the folding line D.

The side member 2C also has a right-angled slit 20*b*, but the side member 2A does not.

Each bottom member (2B and 2D) includes a lower bottom section 9A, upper bottom section 9B, and inner wall section 10. The lower bottom section 9A is defined by the folding line A and a folding line F1. The upper bottom section 9B is defined by folding lines F2 and G. The inner wall section 10 is divided from the upper bottom section 9B by a folding line G. The inner wall section 10 has triangular projecting portions 10*a*, 10*a*. The bottom member 2B also has a slit 20*a* in its inner wall section 10, but the other bottom member 2D does not.

Figure 2:
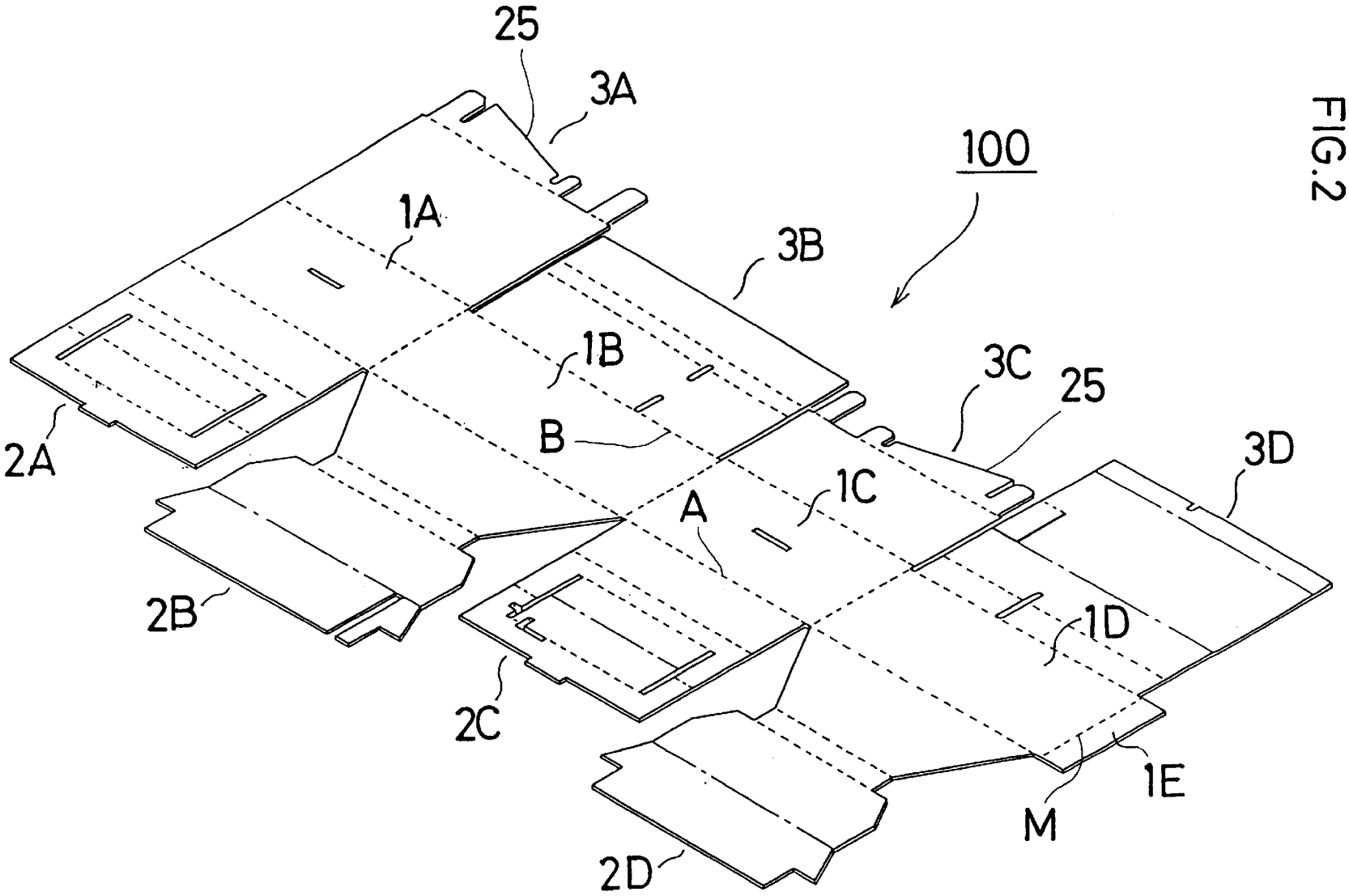
FIG. 2 is a perspective view of the sheet 100 of FIG. 1.

The outer lid member 3A includes a tab section 16A and a cover section 15A which are divided from each other by a longitudinally-extending folding line L. Similarly, the outer lid member 3C includes a tab section 16C and a cover section 15C that are divided from each other by a longitudinally-extending folding line L. Each tab section (16A and 16C) includes opposed long projecting portions 21, 21, a short projecting portion 18, and an inclined edge 25 (FIG. 2).

The inner lid member 3B has two aligned slits 17A and 17B and two parallel folding lines H1 and H2.

The other inner lid member 3D includes a tab section 14, cover section 13, inner wall section 12, and top section 11. The tab section 11 includes a small cut 26, and is divided from the cover section 13 by a longitudinally-extending folding line K. The cover section 13 has a flap 20*c* that is defined by a folding line 27 and a right-angled cut 28. The inner wall section 12 is divided from the cover section 13 by a folding line J. The top section 11 is divided from the inner wall section 12 by a folding line I. A slit 17C starts from the inner wall section 12 and extends up to the folding line B.

Figure 3:
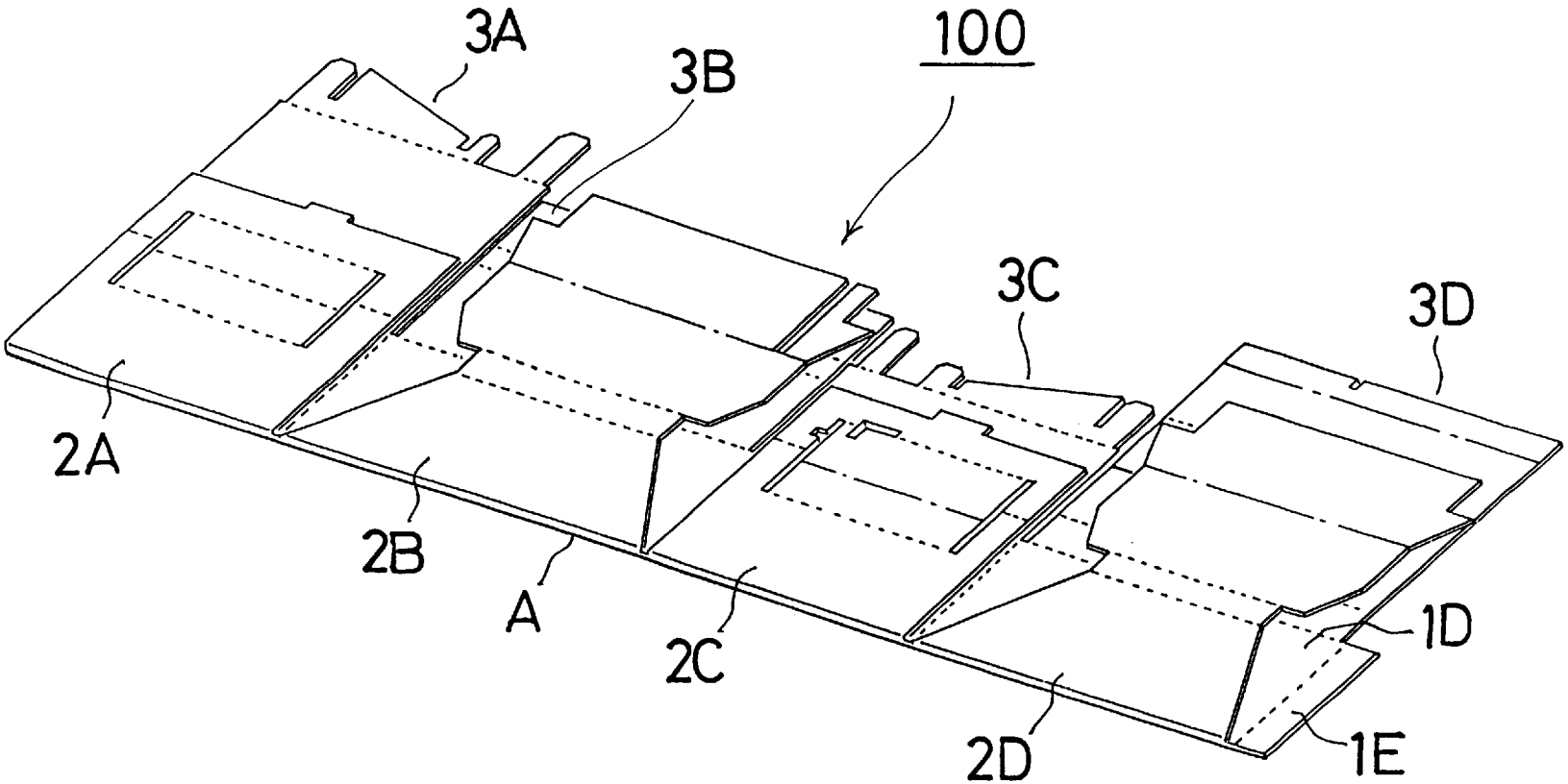
FIG. 3 shows a first folding step of the sheet 100.
Figure 4:
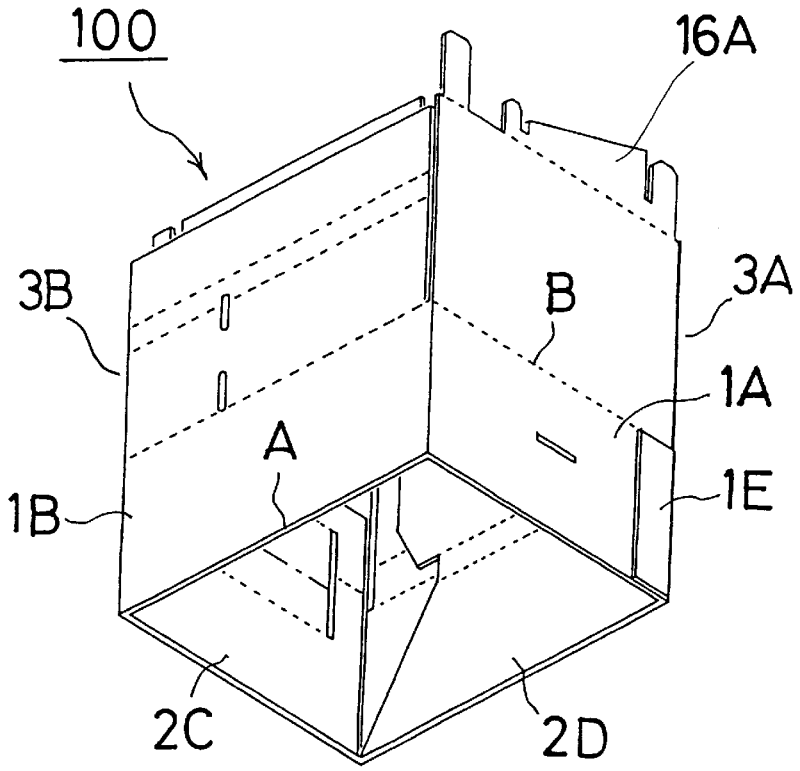
FIG. 4 shows a square shape produced by folding the sheet 100 of FIG. 3.
Figure 5:
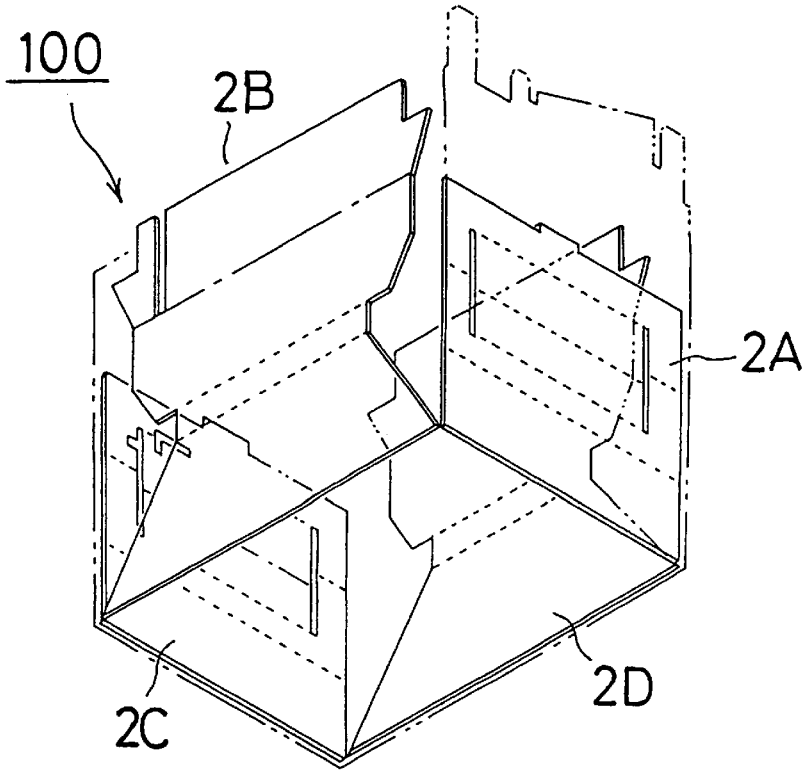
FIG. 5 illustrates an inner construction of the square shape of FIG. 4.
Figure 13:
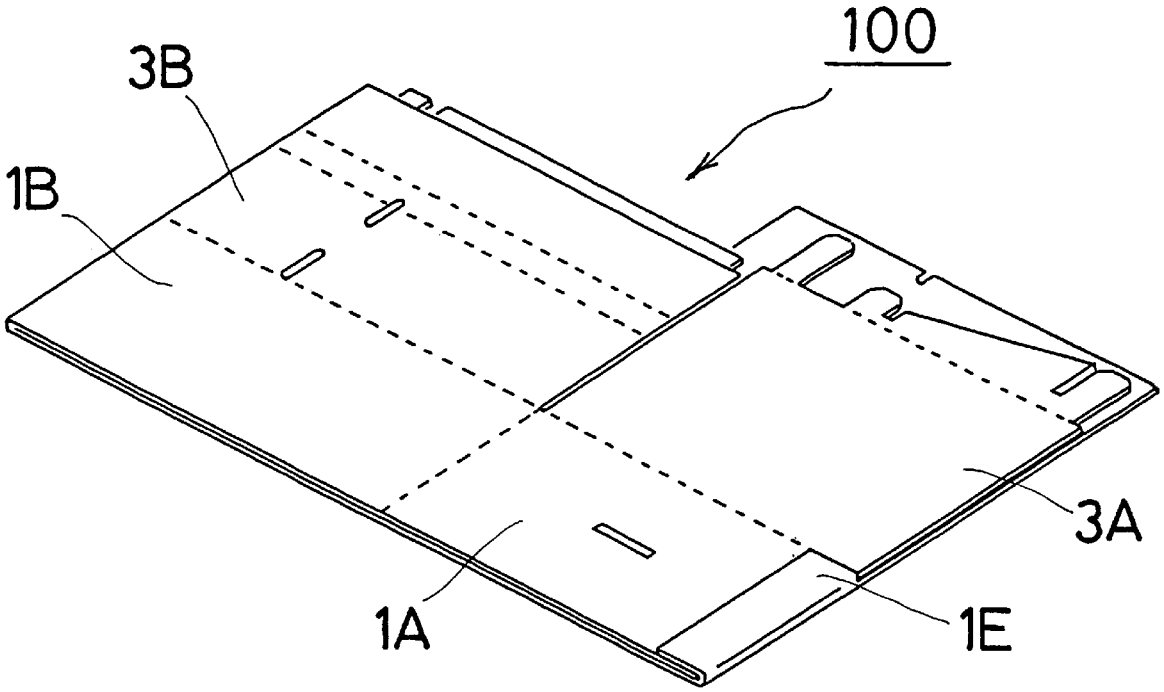
FIG. 13 shows a flat construction obtained by folding the square shape of FIG. 4 flat.

The sheet 100 has such a construction, and can be folded into the package 200 of FIG. 11, as follows. First, as shown in FIG. 3, the sheet 100 is folded in half from the folding line A. Then, as shown in FIG. 4, the side wall members 1A to 1D and tab member 1E are folded along the folding lines N, O, P and M such that the sheet 100, as a whole, forms a square shape with the members 2A to 2D located inside, and then the tab member 1E is glued onto the side wall member 1A. Then, this square object can be folded flat, as shown in FIG. 13. Then, the sheet 100 can be transported in this compact, flat shape to a supplier of a product to be packed with the sheet 100. Then, the supplier brings the sheet 100 back to the square shape of FIG. 4. Then, each bottom member (2B and 2D) is downwardly folded again from the folding line A, and then the bottom member is folded from the folding line F1 toward the associated side wall member 1B or 1D. Thereupon, each side member (2A and 2C) is downwardly folded again from the folding line A to locate the bottom section 24 in a horizontal plane, and next the portion between the folding lines C1 and C2 is folded upright from the folding line C1. Then, the lower shelf section 5 is folded toward the associated side wall member 1A or 1C until the lower shelf section 5 has come to a horizontal position. Then, the inner wall section 6 is folded upright from the folding line D, and next the upper shelf section 7 is folded toward the associated side wall member 1A or 1C until the projecting portion 7*a* has come into the slit 4 of the associated side wall member 1A or 1C. The portions of the bottom member outside the folding lines 8A and 8B are folded along the folding lines 30, 30 into right angles such that the folding lines 30, 30 come exactly above the folding line C1.

Then, the portion of each bottom member (2B and 2D) between the folding lines F1 and F2 is made to stand, and then the upper bottom section 9B is folded toward the associated side wall member 1B or 1D from the folding line F2 until the upper bottom section 9B has become parallel with the lower bottom section 9A. Next, the inner wall section 10 of each bottom member is so folded from the folding line G that the same section 10 becomes parallel with the associated side wall member 1B or 1D. The inner wall section 10 thus becomes a vertical wall located inside the associated side wall 1B or 1D.

Thereupon, one of the triangular projecting portions 10*a*, 10*a* of the bottom member 2B is inserted into the slit 8B of the side member 2A and at the same time the other triangular projecting portion 10*a* of the bottom member 2B is inserted into the slit 8A of the side member 2C. Similarly, one of the triangular projecting portions 10*a*, 10*a* of the bottom member 2D is inserted into the slit 8B of the side member 2C and at the same time the other triangular projecting portion 10*a* of the bottom member 2D is inserted into the slit 8A of the side member 2A.

Figure 6:
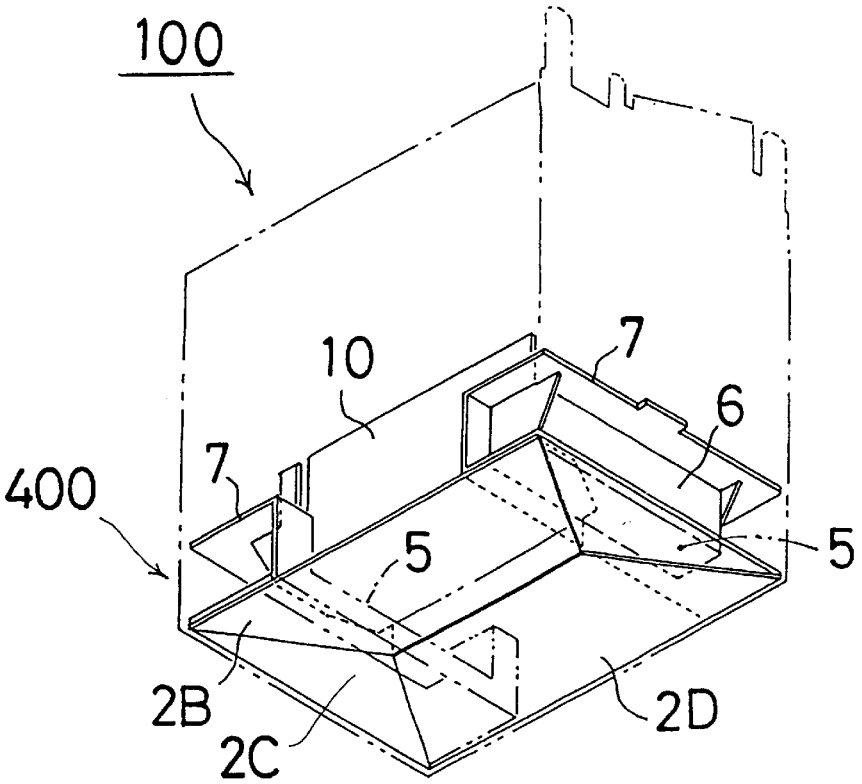
FIG. 6 shows a bottom structure 400 provided by folding four members 2A, 2B, 2C, and 2D of FIG. 5.
Figure 7:
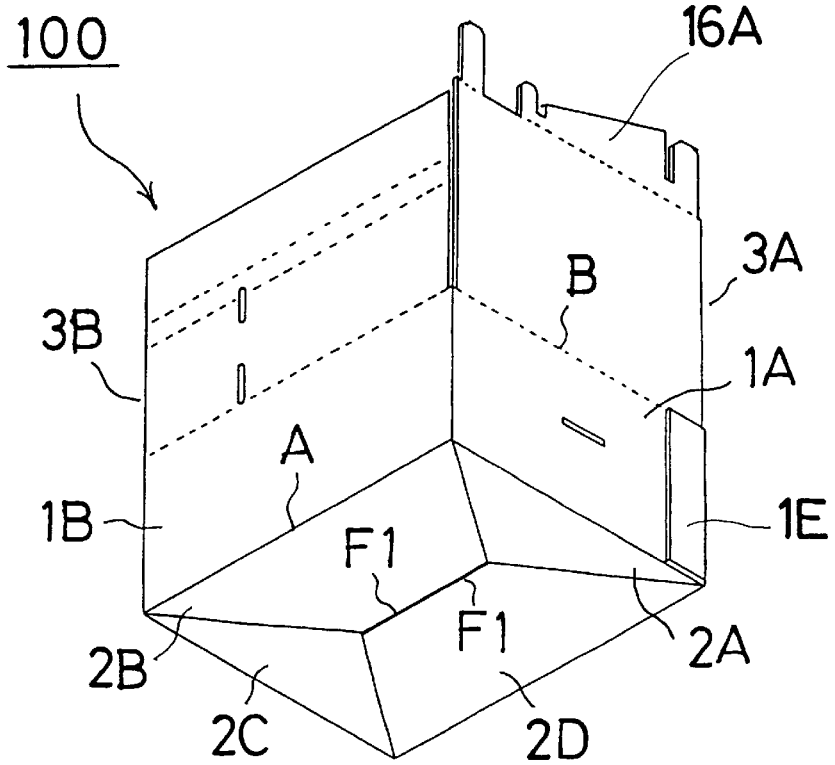
FIG. 7 is a similar view to FIG. 4, but in FIG. 7 the square shape of FIG. 4 now has a bottom through the folding step of FIG. 8.
Figure 8:
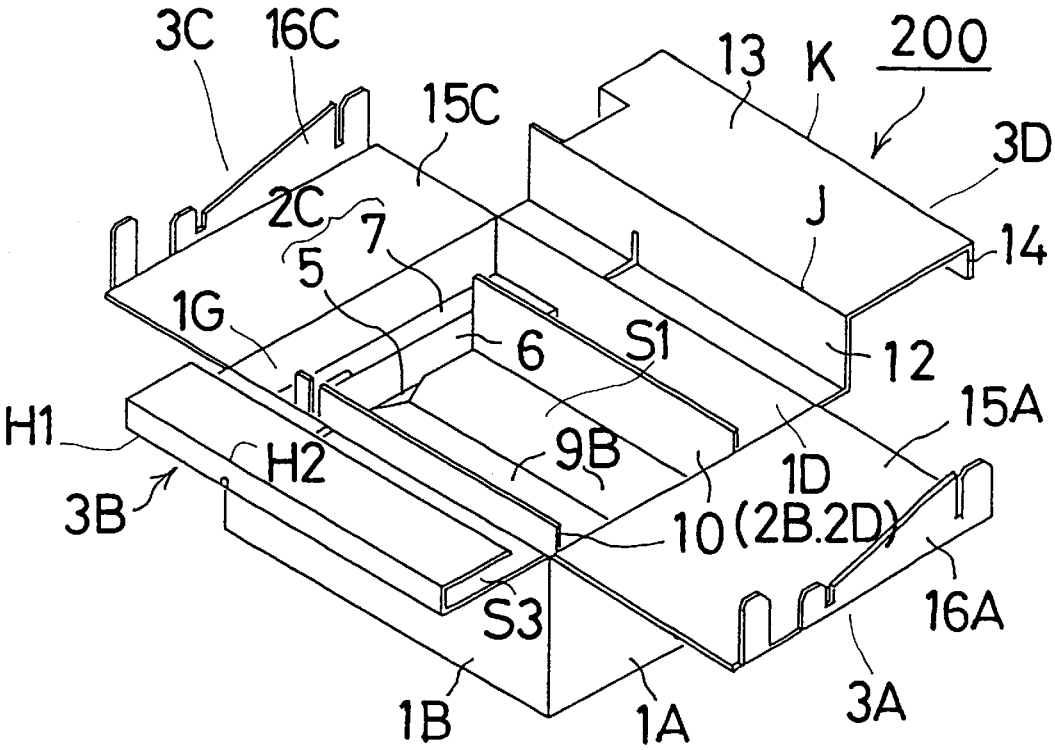
FIG. 8 shows a half-completed package 200 obtained by further folding the square construction of FIG. 7.
Figure 12:
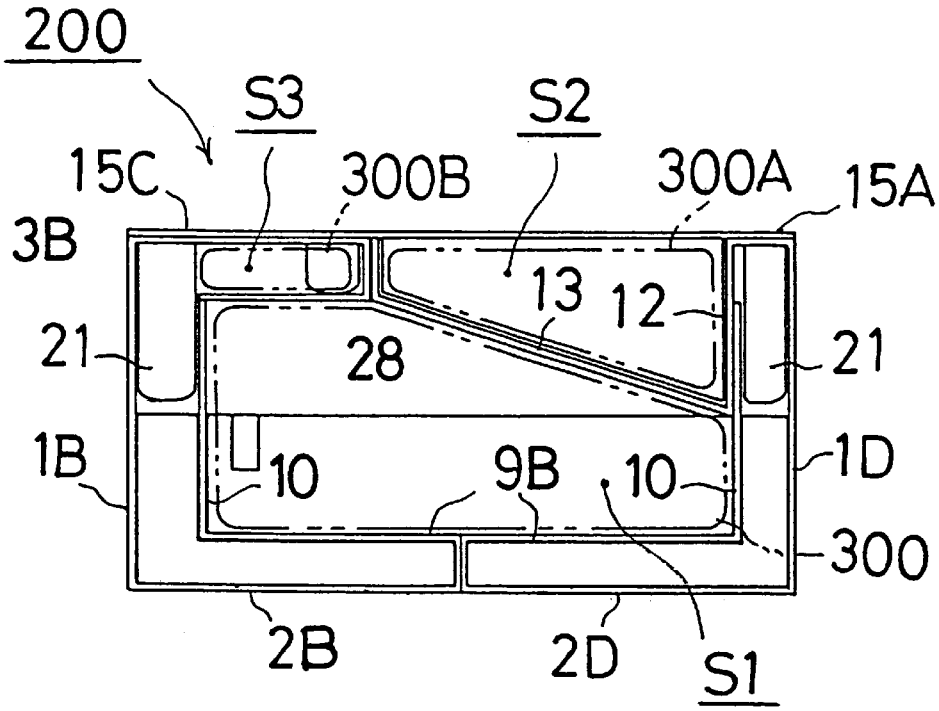
FIG. 12 is a vertical cross section of the completed package 200 of FIG. 11, taken on line Y—Y of FIG. 11.

Through these folding steps, the members 2A to 2D form a structure 400 of FIG. 6. This structure 400 may be called a "bottom structure" in a broad sense. By taking a look at FIG. 8, one can see what this structure 400 looks like when viewed from above. As shown in FIG. 8, this structure 400 provides an inner space S1 (FIGS. 8 and 12) in which to place a product 300 (FIG. 12), such as a fax machine. Thus this structure 400 also may be called an "inner product accommodating structure." In this structure 400, four sections, namely, the lower and upper bottom sections 9A and 9B of the bottom member 2B and the lower and upper bottom sections 9A and 9B of the bottom member 2D, constitute one double bottom. The lower bottom section 9A of each bottom member (2A and 2B) and the upper bottom section 9B thereof now located above the lower bottom section 9A make up one half of the double bottom.

Also, as can be seen from FIG. 8, the side wall member 1B and the inner wall section 10 of the bottom member 2B, now located inside the side wall member 1B, form one double side wall, and the side wall member 1D and the inner wall section 10 of the bottom member 2D, now located inside the side wall member 1D, form an opposed double side wall. Similarly, it can be said that, as well as serving to hold the bottom members 2B and 2D in place, each side member (2A and 2C) also makes up one double side wall together with the side wall member 1A or 1C. Thus the package 200, produced by folding the sheet 100 but not yet completed at this point of time, has four double side walls.

Next, all the upper members 3A to 3D are folded outwardly from the folding line B (FIG. 8). Then, the tab section (16A and 16C) of each outer lid member (3A and 3C) is folded upright from the folding line L (FIG. 8). Also, the inner lid member 3B is folded inward along the folding lines H1 and H2 (FIG. 8). An accessory accommodating space S3 (FIG. 8) is thus formed in the inner lid member 3B. The inner wall section 12 of the inner lid member 3D is folded upright from the folding line I, the cover section 13 of the same lid member 3D is folded from the folding line J into a horizontal position, and the tab section 14 of the same member 3D is folded downwardly from the folding line K (FIG. 8). The sheet 100 thus comes to form the shape of FIG. 8.

Figure 9:
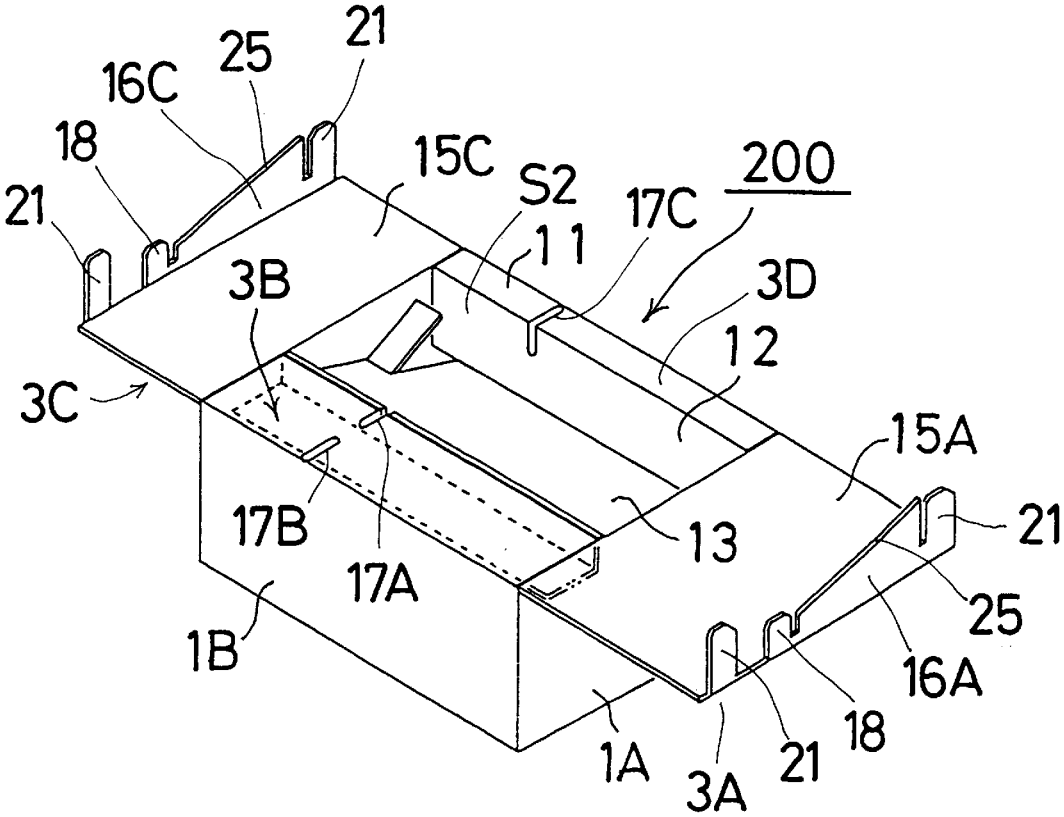
In FIG. 9, inner lid members 3B and 3D of the half-completed package 200 of FIG. 8 are closed.
Figure 10:
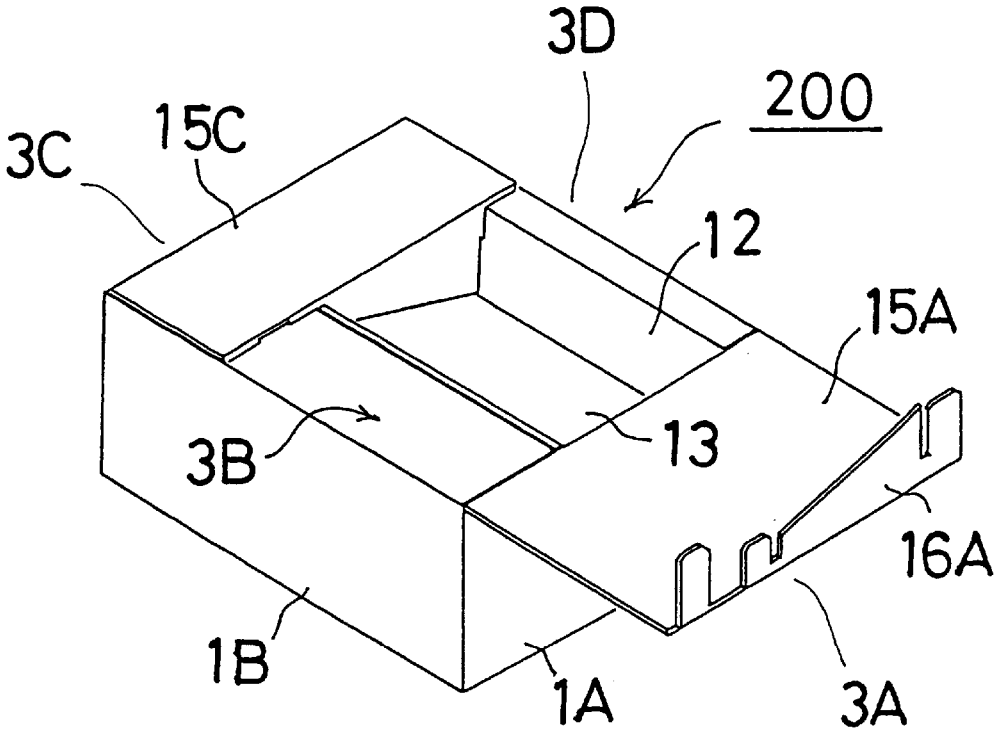
FIG. 10 shows the package 200 of FIG. 9 with its one outer lid member 3C also closed.

Thereupon, a product 300, such as a fax machine, is placed in the product accommodating space S1. The product 300, however, is not shown in FIG. 8 but is outlined in FIG. 12. This space S1, however, is not large enough to accommodate the complete body of product 300 but only contains the greater part of the product 300. Then, accessories 300B (FIG. 12) for the product 300, although not shown in FIG. 8, can be put into the accessory accommodating space S3 of the inner lid member 3B, and next, as shown in FIG. 9, the inner lid member 3B is folded inward from the folding line B to cover the product 300 with the same member 3B. Also, as shown in FIG. 9, the other inner lid member 3D is folded inward from the folding line B to cover an inclined surface 28 of the product 300 with the cover section 13. As a result, as shown in FIG. 9, the top section 11 of the inner lid member 3D becomes a top of one side wall (one double side wall) of the package 200 that is now almost completed. Also, as a consequence, the tab section 14 of the inner lid member 3D comes into contact with the vertical portion of the inner lid member 3B between the folding lines H1 and H2, with its small cut 26 becoming joined with the slit 17A of the inner lid member 3B. Also, as a result, the inner wall section 12, cover section 13 (now positioned in an inclined plane) and tab section 14 form another accessory accommodating space S2 (FIG. 9). Then, additional accessories 300A (FIG. 12) for the product 300, although not shown in FIG. 9, can be placed in this space S2. Thereupon, each outer lid member (3A and 3C) is folded inward until its long projecting portions 21 and 21 have come into the slit 17B of the inner lid member 3B and the slit 17C of the inner lid member 3D, respectively, and its short projecting portion 18 into the slit 17A of the inner lid member 3B. In FIG. 11 the outer lid member 3C is first folded in this manner. As a result, the inclined edge 25 of each outer lid member (3A and 3C) comes to the same inclined plane as the cover section 13 of the inner lid member 3D, so that the inclined edge 25 comes into exact contact with the cover section 13. The package 200 of FIG. 11 is thus completed.

As indicated above, when the tab section 14 of the inner lid member 3D comes into contact with the vertical portion of the inner lid member 3B between the folding lines H1 and H2, its small cut 26 becomes joined with the slit 17A of the inner lid member 3B. This makes it easy for the short projecting portion 18 of each outer lid member (3A and 3B) to come into the slit 17A of the inner lid member 3B.

The long projecting portions 21 and 21 and short projecting portion 18 of each outer lid member (3A and 3C) not only function to join the outer lid member with the inner lid members but one long projecting portion 21 also serves to keep the thickness of a double wall construction formed by the side wall member 1D, top section 11 and inner wall section 12 intact and the other long projecting portion 21 and short projecting portion 18 also serve to keep the width of the inner lid member 3B intact.

The slits 20*a* and 20*b* and flap 20*c* of the sheet 100 function to receive projecting portions of the product 300.

What is claimed is:

1. A sheet (100) of corrugated paper for producing a package, comprising:

(i) first, second, third, and fourth side wall members (1A, 1B, 1C, 1D) that are divided from other members of the sheet by first and second parallel folding lines (A, B) extending from one edge of the sheet to an opposed edge thereof and that are divided from one another by parallel transversely-extending folding lines (N, O, P);

(ii) a tab member (1E) provided subsequent to the fourth side wall member (1D) and divided therefrom by a further transversely-extending folding line (M);

(iii) a first side member (2A), a first bottom member (2B), a second side member (2C), and a second bottom member (2D) which are located on one side of the first, second, third and fourth side wall members (1A, 1B, 1C, 1D), respectively, and which are divided from the side wall members (1A, 1B, 1C, 1D) by the first parallel folding line (A), and (iv) a first outer lid member (3A), a first inner lid member (3B), a second outer lid member (3C), and a second inner lid member (3D) that are located on an opposed side of the first, second, third and fourth side wall members (1A, 1B, 1C, 1D), respectively, and which are divided from these side wall members (1A, 1B, 1C, 1D) by the second parallel folding line (B) and wherein:

(A) the first and third side wall members (1A, 1C) are provided with first longitudinally-extending slits (4, 4), respectively;

(B) each said side member (2A, 2C) includes parallel transversely-extending slits (8A, 8B) and parallel first longitudinally-extending folding lines (C1, C2, D, E);

(C) each said side member (2A, 2C) also has a bottom section (25) located between the first parallel folding line (A) and a first of said first longitudinally-extending folding lines (C1), a lower shelf section (5) defined by a second and a third folding lines (C2, D) of said first longitudinally-extending folding lines and the parallel transversely-extending slits (8A,8B), a first inner wall section (6) defined by the third and fourth folding lines (D, E) of said first longitudinally-extending folding lines and the parallel transversely-extending slits (8A,8B), an upper shelf section (7) divided generally from the first inner wall section (6) by the fourth folding line (E) of said first longitudinally-extending folding lines, a projecting portion (7A), and second longitudinally-extending folding lines (30, 30) that are aligned with each other but are slightly offset against the third folding line (D) of said first parallel longitudinally-extending folding lines;

(D) each said bottom member (2B, 2D) includes parallel third longitudinally-extending folding lines (F1, F2, G);

(E) each said bottom member (2B, 2D) also has a lower bottom section (9A) located between the first parallel folding line (A) and a first folding line (F1) of said third longitudinally-extending folding lines, an upper bottom section (9B) located between the second and third folding lines (F2, G) of said third longitudinally-extending folding lines, and a second inner wall section (10) divided from the upper bottom section (9B) by the third folding line (G) of said third longitudinally-extending folding lines and having additional projecting portions (10*a*, 10*a*);

(F) the first outer lid member (3A) includes a first cover section (15A) and a first tab section (16A) that are divided from each other by a further longitudinally-extending folding line (L);

(G) the first tab section (16A) includes first opposed long projecting portions (21, 21), a first short projection portion (18), and a first inclined edge (25);

(H) the second outer lid member (3C) includes a second cover section (15C) and a second tab section (16C) that are divided from each other by another longitudinally-extending folding line (L);

(I) the second tab section (16C) includes second opposed long projecting portions (21, 21), a second short projecting portion (18), and a second inclined edge (25);

(J) the first inner lid member (3B) has fourth parallel longitudinally-extending folding lines (H1, H2) and transversely-extending aligned slits (17A, 17B);

(K) the second inner lid member (3D) has fifth parallel longitudinally-extending folding lines (K, J, I);

(L) the second inner lid member (3D) also includes a third tab section (14) with a small cut (26), a third cover section (13) divided from the third tab section (14) by a first folding line (K) of said fifth longitudinally-extending folding lines, a third inner wall section (12) divided from the third cover section (13) by a second folding line (J) of said fifth longitudinally-extending folding lines, and a top section (11) located between the third folding line (I) of said fifth longitudinally-extending folding lines and said first parallel folding line (A), and (M) a further transversely-extending slit (17C) starting from the third inner wall section (12) and extending up to the second parallel folding line (B).

2. A sheet of corrugated paper in accordance with claim 1 wherein:

(I) the second inner wall section (10) of the first bottom member (2B) is provided with still a further transversely-extending slit (20*a*);

(II) the second side member (2C) also has a right-angled slit (20*b*), and (III) the third cover section (13) of the second inner lid member (3D) has a flap (20*c*) that is defined by an additional longitudinally-extending folding line (27) and a right-angled cut (28).

3. A method for folding the sheet (100) of corrugated paper of claim 1 into a package (200), which comprises the steps of:

(A) folding the sheet (100) in half from the first folding line A such that the first side member (2A) comes on top of the first side wall member 1A and first outer lid member (3A), the first bottom member (2B) on top of the second side wall member (1B) and first inner lid member (3B), the second side member (2C) on top of the third side wall member (1C) and second outer lid member (3C), and the second bottom member (2D) on top of the fourth side wall member (1D) and second inner lid member (3D);

(B) folding the side wall members (1A, 1B, 1C, 1D) and tab member (1E) along the parallel transversely-extending folding lines folding lines (N, O, P) and the further transversely-extending folding line (M) such that the sheet (100), as a whole, forms a square shape with the first side member, the first bottom member, the second side member and the second bottom member (2A, 2B, 2C, 2D) located inside;

(C) affixing the tab member (1E) to the first side wall member (1A);

(D) folding each of said first and second bottom members (2B, 2D) downwardly again from the first parallel folding line (A);

(E) folding each of said first and second bottom members (2B, 2D) from the first folding line (F1) of said third longitudinally-extending folding lines toward the associated second and fourth side wall members (1B, 1D);

(F) folding each of said first and second side members (2A, 2C) downwardly folded again from the first parallel folding line (A) to locate the bottom section (24) thereof in a horizontal plane;

(G) folding a portion between the first and second folding lines (C1, C2) of said first longitudinally-extending folding lines upright from the first folding line (C1) of said first longitudinally-extending folding lines;

(H) folding the lower shelf section (5) toward the associated side wall members (1A, 1C) until the lower shelf section (5) comes to a horizontal position;

(I) folding the first inner wall section (6) upright from the third folding line (D) of said first parallel longitudinally-extending folding lines;

(J) folding the upper shelf section (7) toward the associated side wall members (1A, 1C) until the projecting portion (7*a*) comes into the associated first longitudinally-extending slits (4) of the associated side wall member (1A, 1C);

(K) folding portions of each said first and second bottom members (2B, 2D) outside the transversely-extending slits (8A, 8B) along the second longitudinally-extending folding lines (30, 30) into right angles such that the second longitudinally-extending folding lines (30, 30) come exactly above the first folding line (C1) of said first longitudinally-extending folding lines;

(L) standing a portion of each said bottom member (2B, 2D) between the first and second folding lines (F1, F2) of said third longitudinally-extending folding lines;

(M) folding the upper bottom section (9B) of each said first and second bottom members (2B, 2D) from the second folding line (F2) of said third longitudinally-extending folding lines toward the associated side wall member (1B, 1D) until the upper bottom section (9B) becomes parallel with the lower bottom section (9A);

(N) folding the second inner wall section (10) of each said bottom member from the third folding line (G) of said third longitudinally-extending folding lines so that the same second inner wall section (10) becomes parallel with the associated side wall member (1B, 1D);

(O) inserting one of the additional projecting portions (10*a*, 10*a*) of the first bottom member (2B) into the transversely-extending slit (8B) of the first side member (2A), as well as inserting the other triangular additional projecting portion (10*a*) thereof into the transversely-extending slit (8A) of the second side member (2C);

(P) inserting one of the additional projecting portions (10*a*, 10*a*) of the second bottom member (2D) into the transversely-extending slit (8B) of the second side member (2C), as well as inserting the other additional projecting portion 10*a* of the second bottom member (2D) in to the transversely-extending slit (8A) of the first side member (2A);

(Q) folding the first and second outer lid members (3A, 3C) and the first and second inner lid members (3B, 3D) outwardly from the second parallel folding line (B);

(R) folding the first and second tab sections (16A, 16C) of each said outer lid member (3A, 3C) upright from the longitudinally-extending folding line (L);

(S) folding the first inner lid member (3B) inward along the fourth parallel longitudinally-extending folding lines (H1, H2) to provide an accessory accommodating space (S3) therein;

(T) folding the third inner wall section (12) of the second inner lid member (3D) upright from the third folding line (I) of said fifth parallel longitudinally-extending folding lines, folding the third cover section (13) of the same second inner lid member (3D) from the second folding line (J) of said fifth parallel longitudinally-extending folding lines into a horizontal position, and folding the third tab section (14) of the same second inner lid member (3D) downwardly from the first folding line (K) of said fifth parallel longitudinally-extending folding lines;

(U) placing a product (300) in a product accommodating space (S1) as formed by the upper bottom sections (9B, 9B) of the first and second bottom members (2B, 2D), the second inner wall sections (10, 10) thereof, and the first and second side members (2A, 2C);

(V) placing accessories (300B) for the product (300) in the accessory accommodating space (S3), if desired;

(W) folding the first inner lid member (3B) inward from the second parallel folding line (B) to cover the product (300) with the same first inner lid member (3B), as well as folding the second inner lid member (3D) inward from the second parallel folding line (B) to cover an inclined surface (28) of the product (300) with the third cover section (13);

(X) placing additional accessories (300A) in another accessory accommodating space (S2) as formed by the third inner wall section (12), third cover section (13) and third tab section (14) of the second inner lid member (3D), and (Y) folding each of the first and second outer lid members (3A, 3C) inward until the long projecting portions (21, 21) thereof have come into the transversely-extending aligned slit (17B) of the first inner lid member (3B) and the further transversely-extending slit (17C) of the second inner lid member (3D), respectively, and the short projecting portion (18) thereof into the transversely-extending aligned slit (17A) of the first inner lid member (3B).

4. A package of corrugated paper produced by the method of claim 3, which is characterized in that:

(a) four sections, namely, the lower and upper bottom sections (9A, 9B) of the first bottom member (2B) and the lower and upper bottom sections (9A, 9B) of the second bottom member (2D), constitute a double bottom;

(b) the second side wall member (1B) and the second inner wall section (10) of the first bottom member (2B) form one double side wall, and the fourth side wall member (1D) and the second and third inner wall sections (10, 12) of the second bottom member (2D) and second inner lid member (3D) form an opposed double side wall, and (c) the first side member (2A) and the first side wall member (1A) make up one double side wall, and the second side member (2C) and the third side wall member (1C) make up an opposed double side wall.

* * * * *